US011241045B2

(12) United States Patent
Doyle et al.

(10) Patent No.: US 11,241,045 B2
(45) Date of Patent: Feb. 8, 2022

(54) VAPORIZER WITH BUILT-IN CHILD PROTECTION

(71) Applicant: The Kanvas Company Inc., Newport Beach, CA (US)

(72) Inventors: Joseph Gordon Doyle, Fountain Valley, CA (US); Andy Fathollahi, Newport Beach, CA (US); Alexander Wayne Gordon, Irvine, CA (US)

(73) Assignee: The Kanvas Company Inc., Newport Beach, CA (US)

( * ) Notice: Subject to any disclaimer, the term of this patent is extended or adjusted under 35 U.S.C. 154(b) by 107 days.

(21) Appl. No.: 16/848,689

(22) Filed: Apr. 14, 2020

(65) Prior Publication Data

US 2020/0337378 A1 Oct. 29, 2020

Related U.S. Application Data

(60) Provisional application No. 62/839,546, filed on Apr. 26, 2019.

(51) Int. Cl.

| | |
|---|---|
| ***A24F 13/00*** | (2006.01) |
| ***A24F 40/49*** | (2020.01) |
| ***A24F 40/60*** | (2020.01) |
| ***A24F 40/53*** | (2020.01) |
| *A24F 40/46* | (2020.01) |

(52) U.S. Cl.

CPC ..... *A24F 40/49* (2020.01); *A24F 40/53* (2020.01); *A24F 40/60* (2020.01); *A24F 40/46* (2020.01)

(58) Field of Classification Search

CPC ..... A24F 47/00
USPC ..... 131/329
See application file for complete search history.

(56) References Cited

U.S. PATENT DOCUMENTS

2016/0150824 A1* 6/2016 Memari ..... H05K 999/00 131/329
2017/0210520 A1* 7/2017 Woodward ..... B65D 47/18

* cited by examiner

*Primary Examiner* — Phuong K Dinh
(74) *Attorney, Agent, or Firm* — Hackler Daghighian Martino & Novak

(57) ABSTRACT

Vaporizers with protection are disclosed. The vaporizers includes a built-in child protective mechanism adapted to connect and disconnect the power source from the heating element of the vaporizer thereby mitigating the ability of a child to activate the vaporizer.

17 Claims, 3 Drawing Sheets

VAPORIZER WITH BUILT-IN CHILD PROTECTION

INCORPORATION BY REFERENCE TO RELATED APPLICATIONS

The present application claims benefit of and priority to U.S. Provisional Patent Application No. 62/839,546, filed Apr. 26, 2019, which is hereby incorporated herein by reference in its entirety.

TECHNICAL FIELD

The field of the invention relates to vaporizing devices, such as electronic vaporizers, and to systems and method of using, controlling and making such devices in a manner that protects children from using, accessing, or otherwise operating the device.

BACKGROUND

Vaporizers, also known as electronic vaporizers ("e-vaporizers"), vapes, vape-pen, electronic nicotine delivery systems ("ENDS"), and plant-based vaporization devices, are commonly utilized to vaporize vaporizable material for inhalation by a patient, consumer or other end-user. Such vaporizable material may be comprised of a prescription or over-the-counter ("OTC") pharmaceutical, plant-derived products (e.g., cannabis, herbs, spices, etc.), a flavoring substance, and/or combination thereof. The vaporizable material is commonly compounded in a liquid comprised of a propylene glycol, vegetable glycerin, oil, water and/or some other liquid.

Patient and other end-users of such devices often do not store their devices after use in locked compartments or safes. Consequently, such devices may be subject to unauthorized access and use by others, including children. While a variety of child resistant containers (e.g., bags, bottles, jars) have been developed to mitigate unauthorized access to vaporizable material, the inventors here recognized that conventional vaporizer devices, which often after use are either not depleted or contain residual vaporizable material, are insufficient to prohibit children from activating and/or operating such devices.

SUMMARY

Consistent with the foregoing, described herein are vaporizers, systems, and methods that are capable of mitigating against activation and/or operation by children to mitigate unauthorized or unintentional exposure to heat and/or vapor or aerosol generated by the vaporizer. Aspects of the current subject matter relate to a vaporizer that is comprised of a child resistant mechanism that engages and disengages the operative power source of the vaporizer thereby precluding power transmission to the heating element. Particular structures and processes of engaging and disengaging the power source are disclosed.

Additional details regarding the various aspects of the subject matter described herein are set forth in the accompanying drawings and descriptions below and/or are otherwise apparent therefrom. It should be understood that the descriptions and illustrations herein, while illustrative of the various aspects of the disclosed subject matter, it is the claims that are intended to define the appropriate scope of the protected subject matter.

BRIEF DESCRIPTION OF THE DRAWINGS

The accompanying drawings, which are incorporated in and constitute a part of this specification, illustrate certain aspects of the subject matter disclosed herein and together with the description, help explain aspects associated with the disclosed implementations. When practical, the same or similar reference numbers denote the same or similar structures, features, or elements.

FIGS. 2A-2C are exploded side views and FIGS. 2D-2E are exploded perspective views.

DETAILED DESCRIPTION

Figure 1A:
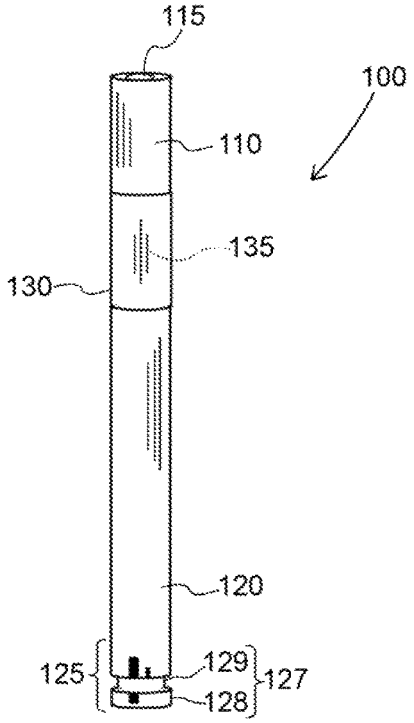
FIG. 1A is a diagram of an exemplary vaporizer, in the form of a vape-pen, with child protective mechanism in accordance with the disclosed subject matter.

FIG. 1A is a simplistic diagram of one example of implementation of a vaporizer 100 having a mouthpiece 115 on an end section of an upper portion 110, a child protective mechanism 125 on an end-section of an opposing lower portion 120 and a vaporizable material container 135 comprising a heating element 136 (illustrated in phantom in FIG. 2C) contained within a mid-portion 130 residing therebetween. The protective mechanism is comprised in part of a retractable component 127 that includes an externally accessible dial or knob 128 and an internally positioned piston 129.

Figure 1B:
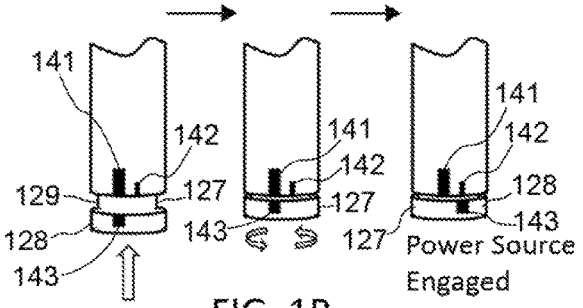
FIGS. 1B and 1C are each a set of diagrams depicting from the user's perspective the operation of the child protective mechanism located at the bottom section of the vaporizer illustrated in FIG. 1A and particularly sequential steps for engaging and disengaging, respectively, the power source from the heating element.

FIG. 1B illustrates the retractable component 127 moving from a first position (on the left), where vaporizer 100 is an inoperable state or configuration to a second position (on the far right) where the vaporizer 100 is in an operable configuration. As illustrated from left to right, to engage the power source housed within vaporizer 100, the user (a) exerts sufficient force (to compress an internal bias element or spring 150 as illustrated in FIG. 1D) on the knob 128 of the retractable component 127 in a direction that pushes the piston 129 through an aperture of the lower portion 120 of the vaporizer 100 housing, (b) then, as illustrated in the middle and right diagrams, the user rotates or turns the knob 128 until the knob is locked into position as illustrated in the far right diagram. Once the knob 128 is locked into position the power source located within the vaporizer 100 is in engaged (as illustrated in the electrical circuit left-side diagram of FIG. 1E) to facilitate operation of the vaporizer 100. The biasing element or spring 150 can be sufficiently sized to adequately resist compression by a child and when combined with the simultaneously required rotation to lock the retractable component 127 into an operable configuration provides a mechanism that protects children by mitigating the ability of a child to activate the vaporizer.

Figure 1C:
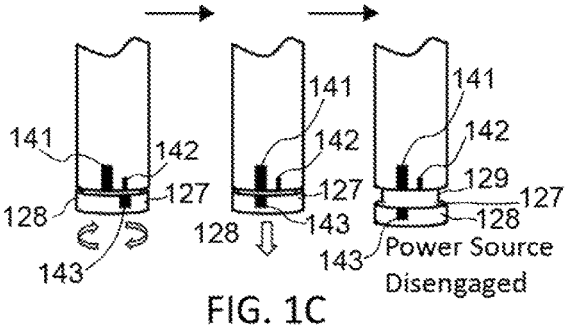
Figure 1D:
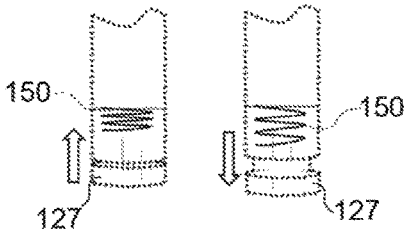
FIG. 1D is a diagram depicting the compression and decompression of an internal spring, associated with engaging and disengaging the power, respectively, of the vaporizer in accordance with an embodiment of the child protective mechanism illustrated in FIGS. 1A-1C.
Figure 1E:
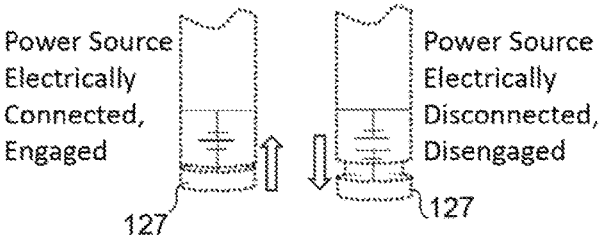
FIG. 1E are electrical diagrams illustrating an electrically connected and disconnected power source corresponding to an engaged and disengaged child protective mechanism in accordance with vaporizer depicted in FIGS. 1A-1D. The diagram on the left corresponds to the diagram on the left of FIG. 1D, wherein the spring is compressed and the diagram on the right corresponds to the diagram on the right of FIG. 1D, wherein the spring is decompressed.

Similarly, FIG. 1C illustrates the retractable component 127 moving from the operable configuration (depicted on the far left) to the an inoperable configuration (on the far right diagram). As illustrated therein, moving from left to right, to disengage the power source housed within vaporizer 100, the user turns the knob 128 (in an opposite direction, e.g., clockwise) to unlock the retractable component 127 and disengage the power source. Once the retractable component 127 is unlocked, it is capable of being un-retracted from the vaporizer housing 120 as illustrated in the middle and far right diagram in FIG. 1C. As illustrated in the right side diagrams of FIGS. 1D and 1E, once unlocked the bias in the compressed spring 150 pushes the retractable component 127 outwardly away from the vaporizer housing 120 and the power source located within the vaporizer 100 is electrically disconnected or disengaged as illustrated on the right side diagram of FIG. 1E.

FIGS. 1A-1C further illustrate visual indicators 141, 142, 143 that are externally positioned on the housing of the vaporizer 100 and on the knob 128 of the retractable component 127. As illustrated therein, the visual indicators 141, 142, 143 are capable of providing visual confirmation to the user with respect to whether the retractable component 127 is in the locked or unlocked position (e.g., wherein the power source is engaged or disengaged).

Figures 2A, 2B, 2C, 2D, 2E:
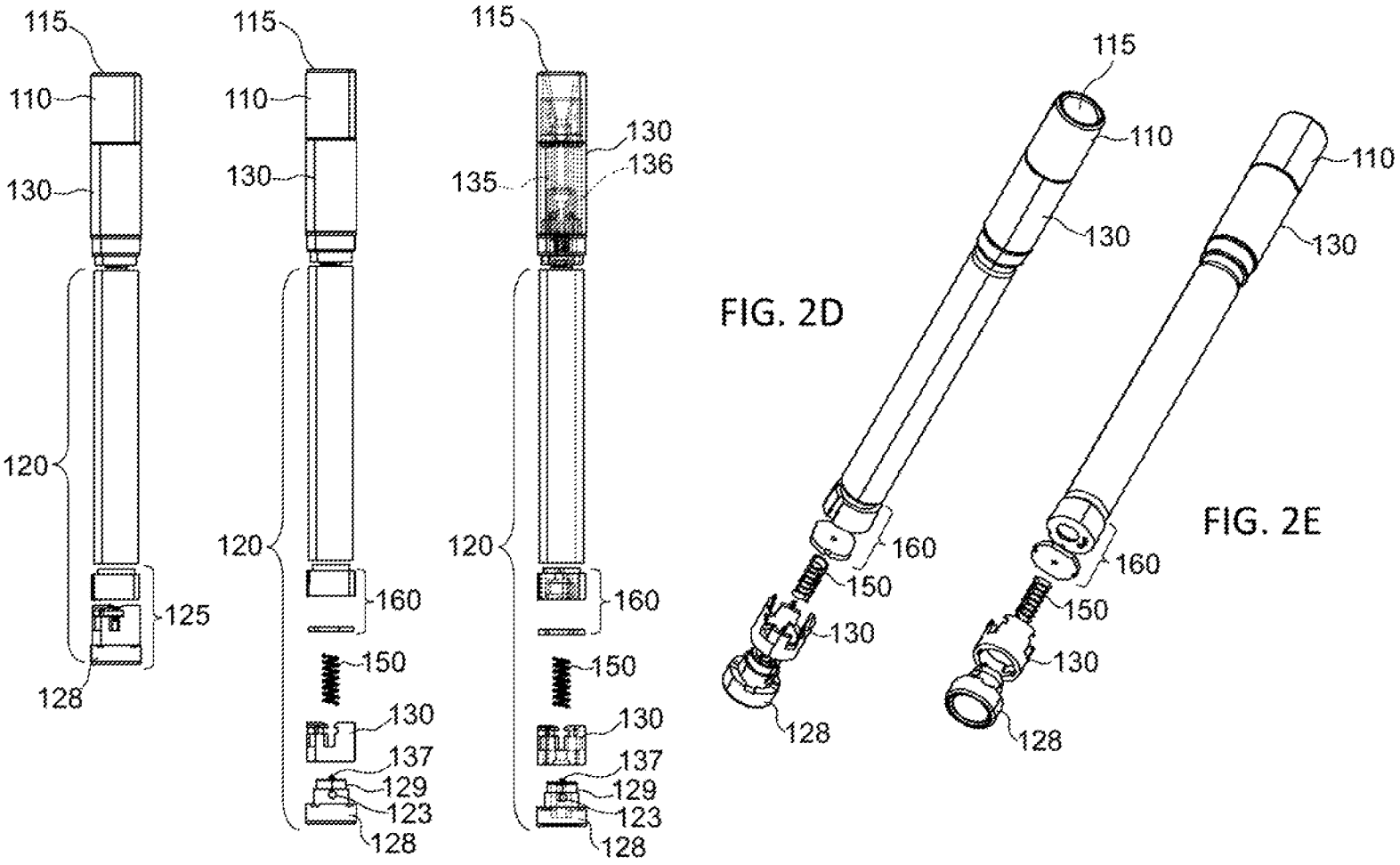
FIGS. 2A-2E are more detailed exploded view diagrams of the vaporizer depicted in FIGS. 1A-1D and the components of the child protective mechanism.
Figure 3:
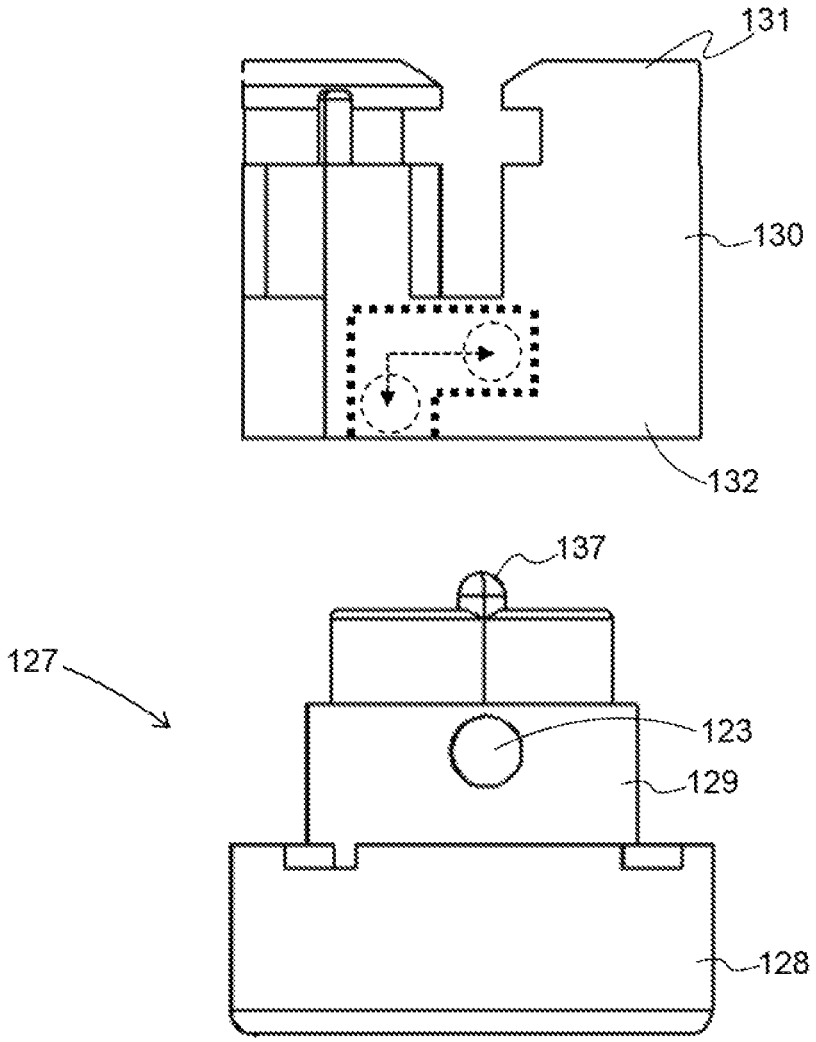
FIG. 3 is a more detailed side view illustration of an implementation of the child protective mechanism illustrated in FIGS. 2A-2E. The dashed lines illustrate the locking channel in the vaporizer and the pathway traveled by the locking pin located on the perimeter of the retractable component of the child protective mechanism.

FIG. 1D illustrates a bias element in the form of a mechanical spring 150 in a compressed configuration (left diagram) corresponding to the locked position of the retractable component 127 illustrated in FIGS. 1B and 1C, and an uncompressed or less compressed configuration (right diagram) corresponding to the unlocked position of the retractable component 127 illustrated in FIGS. 1A-1C. The spring 150 is also illustrated in FIGS. 2B-2D. The spring 150 can be engineered or otherwise designed with sufficient bias or spring force to resist inadvertent engagement and to mitigate against a child compressing the spring 150 to position the retractable component 127 for rotation into the power source engagement position.

As illustrated in FIGS. 2A-2E and FIG. 3, the child protective mechanism 125 can be further comprised of a housing 130 that resides within the aperture of the bottom end section of the vaporizer 100 and into which the retractable component 127 can be received and locked therein. In the illustrated implementation, the housing 130 can be cylindrical in shape extending from a top end section to a bottom end section, 131, 132 respectively and includes an L-Shaped channel 135 on its internal surface that can be open-ended at the bottom end-section 132 of the housing 130. The channel 135 is best depicted by the dashed lines in FIG. 3. The channel 135 can be dimensioned to receive pin 123 that extends radially from the perimeter of the piston 129 of the retractable component 127. The piston 129 extends from the knob 128 on a first end and includes an electrical contact 137 on an opposing end.

In operation, when the retractable component 127 is locked into the engaged position by the user as described above, the piston pin 123 can be guided by the channel 135 in the housing 130 and can be retentively locked into position by opposing pressure exerted by the compressed spring 150. The electrical contact 137 on the insertion end of the piston 129 is configured to electrically engaged with the power source circuitry 160 thereby facilitating electrical connection between the power source and the heating element 136. The electrical connection between the power source and the heating element may be facilitated by the electrical contact 137 by virtue of the electrical contact 137 completing the electrical connection between the power source and the heating element or by a switch mechanism or circuit that is activated when the electrical contact 137 is in the engaged position and deactivated when the electrical contact 137 is in the disengaged position.

It should be understood that any suitable materials or combinations of materials, may be used to form the various components, including plastic, glass, metal, wood, or a combination thereof. It should further be understood that other variations of the power activation and deactivation circuits and mechanism described above may be implemented and that such may be combined with other child resistant or protective mechanisms. Further, although various aspects are herein disclosed in the context of certain preferred embodiments, implementations, and examples, it will be understood by those skilled in the art that the present invention extends beyond the specifically disclosed embodiments to other alternative embodiments and/or uses of the inventive aspects and obvious modifications and equivalents thereof. In addition, while a number of variations of the aspects have been noted, other modifications, which are within their scope, will be readily apparent to those of skill in the art based upon this disclosure. It should be also understood that the scope of this disclosure includes the various combinations or sub-combinations of the specific features and aspects of the embodiments disclosed herein, such that the various features, modes of implementation and operation, and aspects of the disclosed subject matter may be combined with or substituted for one another. Structural and logical substitutions and changes may be made that fall within the scope of this disclosure, which is intended to cover any adaptations and variations of the particular implemented described herein and combination of the various features and component elements thereof. The foregoing and various features, constructions, configurations, and aspects, together with those set forth in the claims and summarized above or otherwise disclosed herein, including the drawings, may alone or in any combination form claims for a device, apparatus, system, method of manufacture, and/or use without limitation. Thus, it is intended that the scope of the present invention herein disclosed should not be limited by the particular disclosed embodiments or implementations described above, but should be determined only by a fair reading of the claims.

What is claimed is:

1. A vaporization device containing a power source and a heating element and extending from a first end section to a second end section, the first end section including a mouthpiece and the second end section including a built-in child protective mechanism adapted to connect and disconnect the power source from the heating element, said child protective mechanism comprises:

an open ended housing fixed within the second end section of the vaporization device and comprising a channel that extends in multiple directions;

a rotatable and retractable component comprising:

a piston on a first end portion and a knob on an opposing second end portion, the piston being received within the housing and adapted to being reversibly movable from a disengaged position to an engaged position, the piston including an electrical contact that connects the power source to the heating element when the piston is in the engaged position and disconnects the power source from the heating element when the piston moves to the disengaged position; and a biasing element contained within the housing biasing the retractable component toward the disengaged position and locking the retractable component in the engaged position when the component is moved thereto.

2. The vaporization device of claim 1, wherein said channel is comprised of an open-ended L-Shaped.

3. The vaporization device of claim 1, wherein said channel is dimensioned to receive a piston pin extending radially from a perimeter of the piston of the retractable component.

4. The vaporization device of claim 3, wherein said piston pin is retentively locked into position by an opposing pressure exerted by a compressed spring.

5. The vaporization device of claim 1 further comprising one or more visual indicators that are externally positioned on the housing for providing visual confirmation to an user with respect to whether the retractable component is in the engaged or disengaged position.

6. The vaporization device of claim 5 further comprising one or more visual indicators that are externally positioned on the knob for providing visual confirmation to the user with respect to whether the retractable component is in the engaged or disengaged position.

7. A vaporization device containing a power source and a heating element and extending from a first end section to a second end section, the first end section including a mouthpiece and the second end section including a built-in child protective mechanism adapted to connect and disconnect the power source from the heating element, said child protective mechanism comprises:

an open ended housing fixed within the second end section of the vaporization device and comprising a channel that extends in multiple directions;

a rotatable and retractable component having a piston on a first end portion and a knob on an opposing second end portion, the piston including a radially extending pin being dimensioned and received within the housing channel and adapted to guide the linear movement and rotation of the piston in the housing between a disengaged position and an engaged position, the piston including an electrical contact that connects the power source to the heating element when the piston is in the engaged position and disconnects the power source from the heating element when the piston moves to the disengaged position; and a biasing element contained within the housing configured to bias the retractable component toward the disengaged position and lock the retractable component in the engaged position when the component is moved thereto.

8. The vaporization device of claim 7, wherein said channel is comprised of an open-ended L-Shaped.

9. The vaporization device of claim 7, wherein said channel is dimensioned to receive a piston pin extending radially from a perimeter of the piston of the retractable component.

10. The vaporization device of claim 9, wherein said piston pin is retentively locked into position by an opposing pressure exerted by a compressed spring.

11. The vaporization device of claim 7 further comprising one or more visual indicators that are externally positioned on the housing for providing visual confirmation to an user with respect to whether the retractable component is in the engaged or disengaged position.

12. The vaporization device of claim 11 further comprising one or more visual indicators that are externally positioned on the knob for providing visual confirmation to the user with respect to whether the retractable component is in the engaged or disengaged position.

13. A method of using a vaporization device containing a power source and a heating element and extending from a first end section to a second end section, the first end section including a mouthpiece and the second end section including a built-in child protective mechanism adapted to connect and disconnect the power source from the heating element, the method comprising:

configuring a retractable component from an inoperable state to an operable state to engage a power source housed within the vaporization device, wherein the configuring the retractable component from the inoperable state to the operable state comprising:

exerting, by an end user, a force on a knob of the retractable component in a first direction to push a piston through an aperture of a lower portion of a housing of the vaporization device; and rotating, by the end user, the knob in a first rotating direction until the knob is locked into an engaged position, wherein the exerting and rotating the knob of the retractable component are performed simultaneously.

14. The method of claim 13 further comprising:

configuring a retractable component from the operable state to the inoperable state to disengage the power source, wherein the configuring a retractable component from the operable state to the inoperable state comprising:

rotating, by the end user, the knob in a second rotating direction opposite to the first rotating direction to unlock the retractable component and disengage the power source.

15. The method of claim 14, wherein once the retractable component is unlocked, a bias in a compressed spring pushes the retractable component outwardly away from the housing.

16. The method of claim 13, wherein the user confirms whether the retractable component is in the engaged position by one or more visual indicators that are externally positioned on the housing.

17. The method of claim 16, wherein the user confirms whether the retractable component is in the engaged position by one or more visual indicators that are externally positioned on the knob.

* * * * *